United States Patent [19]

North

[11] Patent Number: 4,560,169

[45] Date of Patent: Dec. 24, 1985

[54] ZODIAC BOARD GAME

[76] Inventor: Thomas North, 10401 Grosvenor Pl. - #1626, Rockville, Md. 20850

[21] Appl. No.: 613,150

[22] Filed: May 23, 1984

[51] Int. Cl.[4] ..... A63F 3/00

[52] U.S. Cl. ..... 273/242

[58] Field of Search ..... 273/242, 243, 249

[56] References Cited

U.S. PATENT DOCUMENTS

| | | | |
|---|---|---|---|
| 2,549,495 | 4/1951 | Lightfoot | 273/253 |
| 3,099,451 | 7/1963 | Newhouse | 273/253 |
| 3,746,344 | 7/1973 | Hoden | 273/243 |
| 3,785,654 | 1/1974 | Chambers | 273/249 |
| 4,118,035 | 10/1978 | Row | 273/243 |
| 4,359,226 | 11/1982 | Neff | 273/243 |

FOREIGN PATENT DOCUMENTS

| | | | |
|---|---|---|---|
| 1195891 | 6/1970 | United Kingdom | 273/256 |
| 2019228 | 5/1979 | United Kingdom | 273/253 |

*Primary Examiner*—Richard C. Pinkham

*Assistant Examiner*—Benjamin Layno

*Attorney, Agent, or Firm*—Hall, Myers & Rose

[57] ABSTRACT

A zodiac board game comprises a board having a closed path of game spaces thereon, the path being divided into twelve sectors wherein each sector corresponds to a sign of the zodiac and wherein the twelve sectors define four sets of three sectors each, each sector in a set includes at least one special game space, each special game space in a sector in a given set bearing the same one of four different indicia, special game spaces in different sets bearing different indicia; and wherein the indicia of the at least one game space in each sector corresponds to one of four zodiac elements associated with the sign of each sector; and wherein the game piece is movable from one game space to another along a closed path. Preferably, each game piece is shaped to represent the symbol of a corresponding zodiac sign, the identifier of each game piece representing the zodiac element corresponding to the zodiac sign represented by each game piece.

12 Claims, 1 Drawing Figure

ZODIAC BOARD GAME

BACKGROUND OF THE INVENTION

In the past, zodiac board games have been proposed which include card decks, chance devices (such as dice or spinners), currency, and game pieces that are moved about a board representing the zodiac.

Prior board games have also included references to planets and various astrology characteristics and have interrelated board game components in various ways.

However, none of the prior art has taught or suggested a zodiac board game which provides game pieces each of which is a representation of a zodiac symbol and each of which has an identifier thereon which matches indicia borne by game spaces on the board—the identifiers and corresponding indicia preferably representing the zodiac elements of water, air, fire, and earth.

In addition, none of the prior zodiac games feature game piece movement from one game space to another along a closed path in response to one player correctly or incorrectly guessing a number chosen by a second player with a secret number selector—the number-selecting player advancing when there is a wrong guess and the guessing player advancing upon a correct guess (unless the number is zero). This interaction between number-selector, game piece, and game spaces—which provides the elements of skill and intuition, player interaction, judgment and luck—is absent from prior art zodiac board games.

SUMMARY OF THE INVENTION

The present invention is directed to a zodiac board game which is entertaining, simple to learn, and combines the elements of skill, player interaction, judgment, and luck while, at the same time, teaching the players about the zodiac signs and elements.

The zodiac board game achieves the above objects by providing a board having a closed, preferably annular, path of game spaces therealong. The path of game spaces is divided into twelve sectors, each sector corresponding to one of the twelve zodiac signs. In each sector, there is at least one space that bears indicia—that indicia representing the zodiac element associated with the zodiac sign of the sector. In addition, the game includes game pieces each of which is preferably shaped to conform to one of the twelve zodiac signs and each of which preferably bears an identifier which represents the zodiac element associated with the zodiac sign of the game piece. When a game piece of a given zodiac sign is in the sector corresponding to the same zodiac sign, the player has predefined privileges. Similarly, when a game piece (during a player's turn) lands on a space and both relate to the same zodiac element, predefined privileges are provided. Hence, the game teaches the players about the correlation between zodiac signs and zodiac elements.

Furthermore, the game spaces and game pieces are interrelated by player-operable means for secretly selecting one of a plurality of numbers. That is, one player secretly selects a number and another player guesses the chosen number. The number-selecting player or the guessing player advances his game piece depending on whether the guess is incorrect or correct.

In that some game spaces provide privileges, player skill and judgment in both operating the selector and guessing the selected number add to the enjoyment of the game.

DESCRIPTION OF THE INVENTION

1. EQUIPMENT

Figure 1:
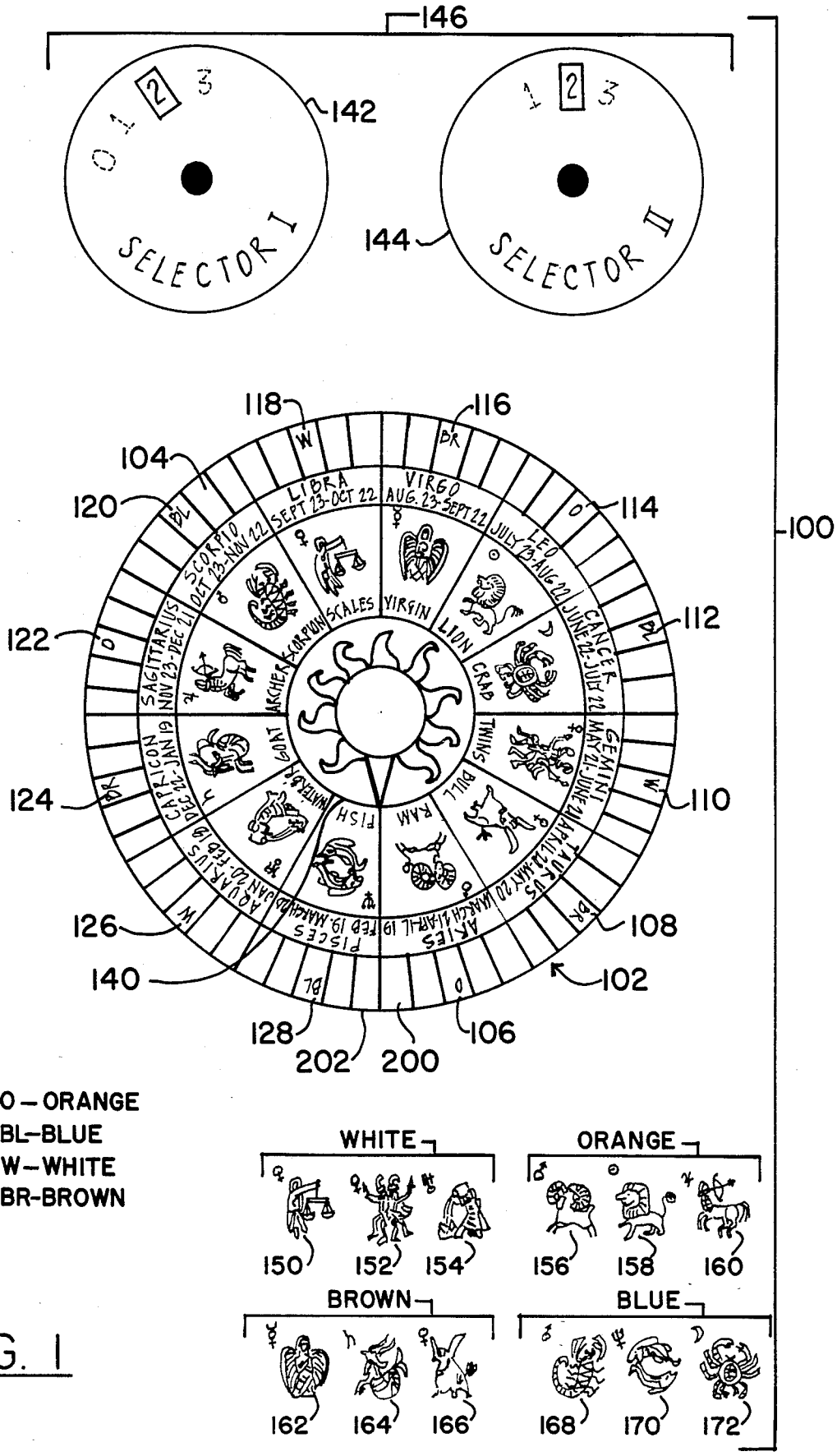
FIG. 1 is an illustration of a game board, game pieces, and selector means according to a preferred form of the present zodiac game.

Referring to FIG. 1, a zodiac board game 100 is shown according to the invention. The game 100 includes a board 102 that provides a closed annular path of game spaces 104. The path is divided into twelve angular sectors each being identified with one of the twelve zodiac signs—namely Aries, Taurus, Gemini, Cancer, Leo, Virgo, Libra, Scorpio, Sagittarius, Capricorn, Aquarius, and Pisces. Each sector is shown to include a plurality of spaces 104.

In each sector, there is shown one special space 106 through 128 which bears an indicia thereon which relates to one of the four customary zodiac elements—namely, earth, air, fire, and water. The zodiac sign for each sector is associated with only one of the four zodiac elements. The indicia borne by the special space in a given sector corresponds to the element associated with the zodiac sign of the given sector. Specifically, Aries, Leo, and Sagittarius are associated with fire and, hence, the special space in each of those three sectors bears an orange fire indicia. Similarly, the special space in each of the Taurus, Virgo, and Capricorn sectors bears a brown earth indicia (corresponding to the earth element).

The special space in each of the Gemini, Libra, and Aquarius sectors bears a white air indicia (corresponding to the air element). The special space in each of the Cancer, Scorpio, and Pisces sectors bears a blue water indicia (corresponding to the water element).

In the center of the board 102 is a circle 140 which circumscribes a sun symbol. Preferably the circle 140 is comparable in diameter to the diameter of each of two-player-operable number selectors 142 and 144 of a number selecting means 146. Selector 142 permits a player to choose 0,1,2, or 3 by simply dialing the selector 142 to a desired position. As shown, the number "2" is exposed. Selector 144 is the same as selector 142, except that only numbers 1, 2, or 3 can be chosen. Either selector 142 or 144 is dimensioned to cover the sun circle 140 when placed face down thereon—as suggested by the dashed arrow. Each selector 142 and 144 has a back face (not shown) through which the players cannot see. A player is thereby able to choose a number on one of the two selectors 142 or 144 and, placing it face down on the sun circle 140, hide the chosen number from the other players.

Also illustrated in FIG. 1 are twelve game pieces 150 through 172 each representing a zodiac symbol that corresponds to a zodiac sign. Each of the game pieces 150 through 172 has a shape corresponding to the symbol it represents and has an identifier that matches one of the zodiac element indicia. As suggested in FIG. 1, the scales 150, twins 152, and water bearer 154 are white—corresponding to the air element associated therewith. The ram 156, lion 158, and archer 160 are orange—corresponding to the fire elements associated therewith. The virgin 162, goat 164, and bull 166 are brown—corresponding to the earth element associated therewith. And the crab 168, fish 170, and scorpion 172 are blue—corresponding to the water element associated therewith.

In accordance with the invention, the board 102 may be formed of any of various conventional materials, such as a rigid cardboard or paper material. Preferably, the board 102 is circular in shape although, alternatively, it may be shaped otherwise. The selectors 142 and 144 are preferably made of plastic and preferably include two concentric relatively rotatable discs one having a number viewing window therein. The selector means 146 may, alternatively, include a single selector that is selectively prevented from displaying a zero. Moreover, the selector means may generally permit a player to choose one of "n" numbers under certain circumstances and one of (n-m) numbers otherwise, when "n" and "m" are positive integers with "n" greater than "m". The game pieces 150 through 172 are preferably made of plastic or metal as desired accordingly to known techniques. As an option the game pieces 150 through 172 may comprise pieces of uniform arcuate shape, each having the zodiac symbol and color corresponding to the respective zodiac element.

2. COOPERATION BETWEEN BOARD, GAME PIECES, AND SELECTOR MEANS

The object of the game is for a player to move a game piece 150 through 172 counterclockwise around the path—starting at a position toward the center of the board 102 inward from the path and travelling in a circle from the first game space 200 in Aries to the last game space 202 in Pisces and thereafter toward the sun circle 140.

A player moves his game piece in response to any of several events. The players, in order, have a turn at secretly choosing a number on one of the two selectors 142 and 144. If the player's game piece is on a space in a sector with a sign corresponding to the zodiac symbol of his game piece, the player (being on a privilege space) uses selector 142. Otherwise the player uses selector 144. After secretly choosing a number, the player places the selector 142 or 144 face down preferably on the sun circle 140.

A second player guesses which number was chosen and turns over the selector 142 or 144 to determine if he was correct. If the guess is correct, the second player advances his game piece the number of game spaces corresponding to the correctly guessed number. If the guess is incorrect, the selecting player advances his game piece. Except when a zero is chosen, the selecting player advances his game piece by the number chosen on either selector in response to an incorrect guess. When a zero is chosen and there is an incorrect guess, the selecting player advances by the number of spaces equal to the incorrect guess.

For example, if the game piece for twins 152 is located in the Gemini sector, the player uses selector 142. If the player chooses zero on the selector 142 and the player to his right (or the player to his left as determined beforehand) guesses "3" incorrectly, the number-selecting player advances three game spaces. Had the guessing player correctly guessed zero, no player would advance his game piece.

In each sector, as noted above, there is one (or more if desired) space that corresponds to the zodiac element associated with the zodiac sign of the sector. These are special or privilege spaces. Specifically, a number-selecting player receives a second consecutive turn at choosing a number on the appropriate one of the selectors in response to his game piece being moved onto a special or privilege game space bearing indicia corresponding to the identifier of his game piece. For example, assume that the number-selecting player has the game piece of the virgin 162. Following an incorrect guess by another player, the number-selecting player lands on game space 124 (or 116 or 108). The game piece of the virgin 162 has a brown identifier (representing the earth element) and matches the brown indicia (also representing the earth element) on the game space 124 (or 116 or 108). The number-selecting player receives another turn.

The privilege spaces serve to either change the odds and/or vary the risk for both the number-selecting player and the guessing player.

The game is played with each player taking a turn in sequence, except when one player receives a second turn as discussed above. When more than two players are in the game, the guessing player for each number-selecting player is predesignated—such as the player to the right. The player that begins the play may be selected in various ways. By way of example, in a two-player context, one chooses a zero or one and the other guesses—the prevailing player going first. With more than two players, game pieces may follow the order of the signs and symbols on the zodiac (starting with the Aries ram 156 and ending with the Pisces fish 170). Alternatively, other methods employing the selectors 142 and 144 or not may be used to determine which player goes first.

Other improvements, modifications, and embodiments will become apparent to one of ordinary skill in the art upon review of this disclosure. Such improvements, modifications and embodiments are considered to be within the scope of this invention as defined by the following claims.

I claim:

1. A board game, comprising:

a board having a closed path of game spaces thereon, the path having a starting point and a finishing point being divided into multiplicity sectors, each sector comprising a plurality of game spaces and each sector corresponding to one of a plurality of indicia where the number of sectors is divisable by the number of indicia into an integer number, a plurality of game pieces for movement from one game space to another along the closed path, each of said game pieces bearing markings corresponding to one of said indicia, player-operated means for secretly selecting one of a first plurality of numbers when the game piece of the number-selecting player is on a game space in a sector corresponding to said game piece indicia, said player-operated means further for selecting one of a second plurality of numbers when said game piece of the number-selecting player is on a game space in a sector not corresponding to said game piece indicia, wherein said first plurality consists of n numbers including zero and said second plurality consists of (n-m) numbers which excludes zero where n and m are each positive predetermined integers with n greater than m, said game piece of the number-selecting player being advanced along the closed path by a number of spaces equal to either (a) the non-zero number selected or (b) a responsive number given in response to the number selected when zero was selected where said responsive number is not identical to said selected number, and a second game piece is advanced along the closed path by a number of spaces equal to the selected number where said responsive number is identical to said selected number.

2. A board game according to claim 1 where said indicia correspond to zodiac based elements and there are 12 sectors corresponding to zodiac signs.

3. A board game according to claim 2 where said game pieces bear indicia corresponding to at least one of said zodiac signs.

4. A board game according to claim 1 where the first plurality consists of the numbers 0, 1, 2 and 3 and the second plurality consists of the numbers 1, 2 and 3.

5. A board game according to claim 1 where said player-operated means is a disk-shaped number selector that permits secret selection of the player selected number and said disk-shaped selector corresponds to an area on the board.

6. A zodiac board game comprising:

a board having a closed path of game spaces thereon, the path being divided into twelve sectors wherein each sector has a plurality of game spaces thereon and wherein each sector corresponds to at least one of four different indicia relating to the zodiac, a plurality of game pieces for movement from one game space to another along the annular path, each game piece bearing indicia corresponding to one of said four zodiac indicia, player-operated means for secretly selecting one of a first plurality of numbers when the game piece of a number-selecting player is on a game space in the sector corresponding to the zodiac indicia represented by said game piece of the number-selecting player, said player-operated means further for secretly selecting one of a second plurality of members when the game piece of a number-selecting player is on a game space outside the sector corresponding to the zodiac indicia represented by said game piece of the number-selecting player wherein said first plurality consists of n numbers including zero and wherein said second plurality consists of (n–m) numbers which excludes zero, where n and m are each positive predetermined digits with n greater than m, wherein the game piece of the number-selecting player is advanced along the closed path by a number of spaces equal to either (a) the non-zero number selected or (b) the number chosen in response to the number selected by the number-selecting player when zero was selected, if the number selected in response is not identical to the number chosen by the number-selecting player; and the game piece corresponding to the response number being advanced along the closed path by a number of spaces equal to the response number when the response number is identical to the selected number.

7. A zodiac board game according to claim 6 where said first plurality consists of the numbers 0, 1, 2 and 3 and said second plurality consists of the numbers 1, 2 and 3.

8. A zodiac board game according to claim 7 where said indicia correspond to one of the four zodiac elements and each of said sectors correspond to one of the twelve zodiac signs.

9. A zodiac board game according to claim 1 further comprising one special game space in each sector corresponds to one of said four zodiac elements different from the zodiac element corresponding to said sector.

10. A zodiac board game according to claim 1 where each of said game pieces has a shape representative of a zodiac sign.

11. A zodiac board game according to claim 7 further comprising a disk-shaped number selector having a window for displaying one number for secretly selecting a number where said selection is hidden to all but the selector.

12. A zodiac board game for at least two players comprising:

a board having a closed path of game spaces thereon, the path being divided into twelve sectors wherein each sector corresponds to a sign of the zodiac and wherein the twelve sectors define four sets of three sectors each, each sector in a set including at least one special game space, each special game space in a sector in a given set bearing the same one of four different indicia, special game spaces in different sets bearing different indicia, a plurality of game pieces for advancing along said closed path, each game piece bearing one of four different identifiers thereon, each of which corresponds to one of said four different indicia on the board, wherein the indicia of the at least one game space in a given sector corresponds to one of four zodiac elements associated with the sign of said given sector, player-operated means for secretly selecting one of a first plurality of numbers when the game piece of a number-selecting player is on a game space in the sector corresponding to the zodiac indicia represented by said game piece of the number-selecting player, said player-operated means further for secretly selecting one of a second plurality of numbers when the game piece of a number-selecting player is on a game space outside the sector corresponding to the zodiac sign represented by said game piece of the number-selecting player, wherein said first plurality consists of the numbers 0, 1, 2, and 3 and said plurality consists of the numbers 1, 2, and 3, said game piece of the number-selecting player being advanced along the closed path by a number of spaces equal to either (a) the non-zero number selected or (b) the number guessed by another player when zero was selected, if the guessing player incorrectly guesses; and said game piece of the guessing player being advanced along the closed path by a number of spaces equal to the number guessed if correct.

* * * * *